US012426697B2

(12) United States Patent
Hwang et al.

(10) Patent No.: US 12,426,697 B2
(45) Date of Patent: Sep. 30, 2025

(54) FREE FLOW POWDER CONTAINER

(71) Applicant: CRYSTAL INTERNATIONAL (GROUP), INC., Scarborough (CA)

(72) Inventors: Roger Ting Chih Hwang, Maple (CA); Stephen M. Fisher, II, Sherman, CT (US); William Lloyd Alusitz, Yorktown Heights, NY (US)

(73) Assignee: CRYSTAL INTERNATIONAL (GROUP), INC., Scarborough (CA)

( * ) Notice: Subject to any disclaimer, the term of this patent is extended or adjusted under 35 U.S.C. 154(b) by 449 days.

(21) Appl. No.: 17/743,419

(22) Filed: May 12, 2022

(65) Prior Publication Data

US 2023/0363511 A1 Nov. 16, 2023

(51) Int. Cl.

| | |
|---|---|
| ***A45D 33/00*** | (2006.01) |
| ***A45D 33/06*** | (2006.01) |
| ***A45D 33/16*** | (2006.01) |

(52) U.S. Cl.

CPC ..... *A45D 33/003* (2013.01); *A45D 33/06* (2013.01); *A45D 33/16* (2013.01)

(58) Field of Classification Search

CPC .... A45D 33/00; A45D 33/003; A45D 33/006; A45D 33/02; A45D 33/025; A45D 33/06; A45D 33/10; A45D 33/16; A45D 33/22; A45C 11/008; A45C 5/005; A45C 13/02

USPC ..... 206/581, 235, 823

See application file for complete search history.

(56) References Cited

U.S. PATENT DOCUMENTS

| | | | | |
|---|---|---|---|---|
| 1,847,948 | A * | 3/1932 | Kasdan | A45D 33/16 132/299 |
| 5,515,875 | A | 5/1996 | Acker et al. | |
| 8,132,578 | B2 | 3/2012 | LoPrete | |
| 8,807,147 | B2 | 8/2014 | Kim et al. | |
| 2009/0188518 | A1* | 7/2009 | Thorpe | A45D 33/006 132/307 |
| 2016/0174682 | A1* | 6/2016 | Chang | A45D 33/025 222/485 |
| 2018/0228266 | A1* | 8/2018 | Caulier | A45D 33/006 |
| 2019/0281948 | A1 | 9/2019 | Eng | |
| 2020/0029672 | A1* | 1/2020 | Wilson | A45D 33/16 |
| 2020/0296721 | A1 | 9/2020 | Baldemair et al. | |
| 2021/0106115 | A1* | 4/2021 | Seguin | A45D 33/16 |

(Continued)

FOREIGN PATENT DOCUMENTS

FR 2974352 B1 8/2014

*Primary Examiner* — Rachel R Steitz
*Assistant Examiner* — Karim Asqiriba
(74) *Attorney, Agent, or Firm* — Patterson + Sheridan, LLP

(57) ABSTRACT

A cosmetic powder container is disclosed herein. The cosmetic powder container has a lid and a receptacle configured to be closed by the lid. The receptacle has a receptacle body. The receptacle body has a bottom and a sidewall partially bounding a powder reservoir. The receptacle body has opening separated from the bottom by the sidewall. A retainer plate is disposed between the powder reservoir and the lid. The retainer plate has a plurality of apertures formed through a top surface of the retainer plate. The plurality of apertures define an open area of the top surface. An upper plenum defined between the lid and the retainer plate is fluidly coupled to the powder reservoir through the plurality of apertures formed in the retainer plate when the receptacle is closed by the lid.

20 Claims, 4 Drawing Sheets

(56) References Cited

U.S. PATENT DOCUMENTS

2021/0378382 A1* 12/2021 Lee ..... A45D 33/04
2022/0312931 A1* 10/2022 Lee ..... A45D 33/008

* cited by examiner

FREE FLOW POWDER CONTAINER

FIELD OF THE INVENTION

The present invention relates generally to containers for powder. More specifically, the present invention relates to a container for cosmetic powder that freely allows powder to flow between a powder reservoir and an application tray even when the container is closed.

BACKGROUND

Powder is a solid substance in the form of tiny loose particles. Powder that is used for application on the human body, especially the face, is known as cosmetic powder.

Cosmetic powder is mainly available in two forms, compressed or compact, and loose. Compressed cosmetic powder has a consistent solid cake form and it is usually packaged in flat-shaped compact cases. Typically, the case also includes a puff or a brush to help a user to apply the powder. A puff is a soft applicator device made from fluffy or deformable fibers. In contrast, a brush is an applicator device with a tuft of hair or bristles that is firmly attached to a shaft or handle. The puff or brush is rubbed over the compact powder surface to loosen some surface powder. The loosened powder sticks to the applicator device, which is then applied to the face.

Loose cosmetic powder as the name suggests, is comprised of finely milled, loose particles, and therefore must be specially contained to avoid spilling. Conventionally, loose powder is contained in a dispenser container having a plurality of perforations on one end of the container. A cap or other closure is provided to seal the perforations and to prevent spilling of the powder. For application of the loose powder, the cap or closure is removed to unplug the perforations. The powder is then shaken out from a powder reservoir of the container and through the perforations either directly onto a puff, or into a tray surrounding the perforations or the underside of the cap from which the powder can then be picked up by a puff or a brush. However, this type of container has very poor control of the amount of powder provided to the tray or cap, often resulting in wasted powder and imprecise amounts of powder being transferred to the applicator, making application of the cosmetic powder frustrating. Additionally, the loose powder may fall out from the perforations into the cap during handling or transportation of the powder container resulting in a mess when the cap is removed. For those powder containers that utilize the cap to apply the loose powder to the brush or puff, the excess or unused powder remaining in the cap must be poured back into the container, which often results in split or wasted powder.

Thus, there is a need for an improved powder container.

SUMMARY

A container for loose powder is disclosed therein that enables free flow of loose powder between a powder reservoir of the container and an application tray of the container while the container remains closed by a lid.

In one example, a cosmetic powder container includes lid and a receptacle configured to be closed by the lid. The receptacle includes a receptacle body and a retainer plate. The receptacle body has a bottom and a sidewall partially bounding a powder reservoir. The receptacle body has an opening separated from the bottom by the sidewall. The retainer plate is disposed between the powder reservoir and the lid. The retainer plate has a plurality of apertures formed through a top surface of the retainer plate. The plurality of apertures defines an open area of the top surface. An upper plenum is defined between the lid and the retainer plate that is fluidly coupled to the powder reservoir through the plurality of apertures formed in the retainer plate when the receptacle is closed by the lid. The plurality of apertures of the retainer plate enable loose powder to flow between the powder reservoir the upper plenum of the container while the container remains closed by the lid.

In some examples, the open area of the top surface of the retainer plate is at least 10 percent. In another example, the open area of the top surface of the retainer plate is at least 50 percent.

In some examples, a portion of the top surface of the retainer plate surrounding at least two sides of one of the plurality of apertures is not flat.

The top surface of the retainer plate may be planar, concave or convex.

In some examples, at least two of plurality of apertures are separated by at least one powder retention feature of the top surface of the retainer plate.

In some examples, the powder retention feature is a lip extending from the top surface of the retainer plate away from the powder reservoir. In other examples, the powder retention feature is a depression formed in the top surface of the retainer plate.

The retainer plate and the receptacle body can either be a single contiguous structure or a module structure.

In some examples, the receptacle body further includes a powder fill port formed in the bottom of the receptacle body.

In other examples, a bottom of a powder application tray is formed partially by the top surface of the retainer plate, and the lid includes projecting surface configured to extend into the powder application tray when the lid closes the receptacle without blocking the apertures formed through the retainer plate.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

Figure 1:
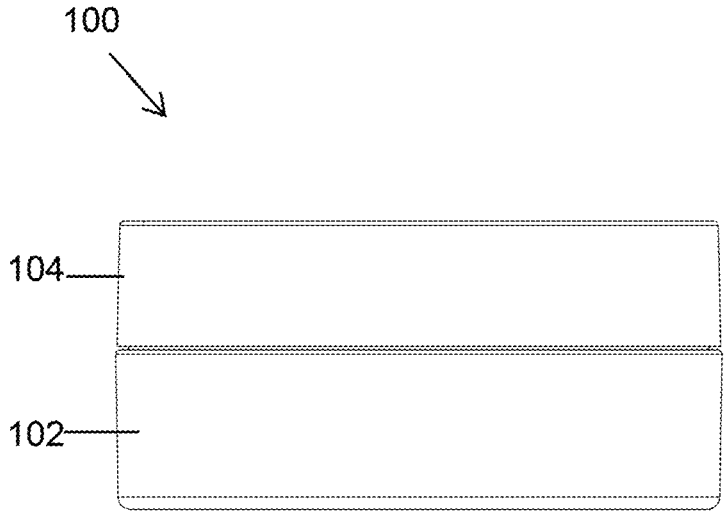
FIG. 1 is a front view of a powder container illustrating a lid secured to a receptacle, in accordance with an embodiment of the present invention.

To facilitate understanding, identical reference numerals have been used, where possible, to designate identical elements that are common to the figures. It is to be noted, however, that the appended drawings illustrate only typical embodiments of this invention and are therefore not to be considered limiting of its scope, for the invention may admit to other equally effective embodiments.

DETAILED DESCRIPTION

A container for loose powder is disclosed therein that enables free flow of loose powder between a powder reservoir of the container and an application tray of the container while the container remains sealed by a lid. The application tray is configured to retain a predefined amount of loose powder while the lid is on the container, with excess powder being able to freely return to the powder reservoir of the container. Once the cap is removed to expose the application tray, the loose powder retained on the application tray can be readily transferred to a brush or puff. Since no excess powder remains on the application tray while transferring powder to the brush or puff, the amount of powder applied by a user is more readily controlled, enabling more precise and repeatable application of the powder by the user. Moreover, since no excess powder remains on the application tray while the container is held in an upright position, the probability of powder escaping the container while securing the cap after use is greatly diminished as compared to conventional designs.

Turning now to FIG. 1, a front view of a powder container 100 is provided. The powder container 100 include a receptacle 102 and a lid 104. The lid 104 is movable and/or removable from the receptacle 102 to allow access to loose powder contained in the receptacle 102 by an applicator puff or brush. In some examples, the lid 104 may be attached to the receptacle 102, for example by a hinge or tether. In other examples, the lid 104 may be completely removable from the receptacle 102, and can snap or screw onto the receptacle 102 to close the container 100.

Figure 2A:
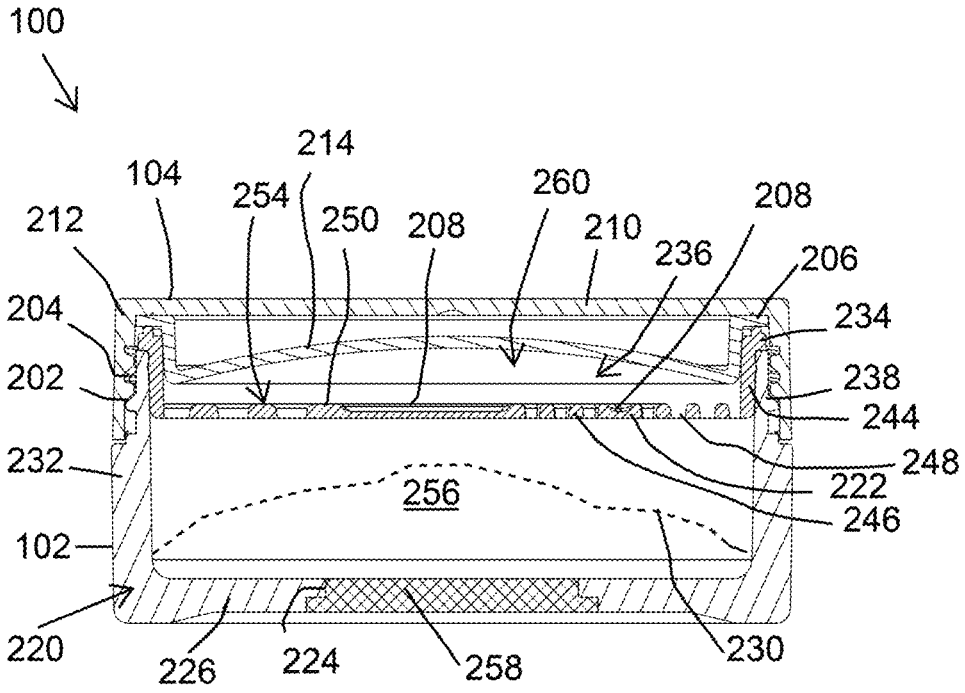
FIG. 2A is a side schematic for the powder container with the lid secured to the receptacle.

FIG. 2A is a side schematic for of the powder container 100 with the lid 104 secured to the receptacle 102. In the example depicted in FIG. 2A, the receptacle 102 and the lid 104 have mating thread forms 202, 204 that may be engaged to secure the lid 104 to the receptacle 102. A seal 206 may deposed between the lid 104 to the receptacle 102 such that when the lid 104 is secured to the receptacle 102, loose powder cannot escape the container 100 from between the lid 104 and the receptacle 102. The seal 206 may be a polymeric material, such as a soft plastic or elastomer. The seal 206 may be attached to one of the lid 104 or the receptacle 102. In the example depicted in FIG. 2A, the seal 206 is retained to the lid 104.

The lid 104 may be fabricated from plastic, ceramic, glass, metal or other suitable material. The lid 104 includes a top 210 and a lip 212. The lip 212 generally extends downward from the top 210 of the lid 104. In the example depicted in FIG. 2A, the inside of the lip 212 includes the female thread form 204.

The receptacle 102 may also be fabricated from plastic, ceramic, glass, metal or other suitable material. The receptacle 102 includes a receptacle body 220 and a retainer plate 222. The receptacle body 220 and the retainer plate 222 may be formed from a single unitary contiguous mass of material (i.e., a singular structure), or may be formed as discrete components (i.e., a modular structure) that are joined to form the receptacle body 220.

In examples where the receptacle body 220 and the retainer plate 222 are formed as singular structure, the receptacle body 220 may include an aperture 224 formed in a bottom 226 of the body 220. The aperture 224 may be used as a powder fill port to load loose powder 230 into a powder reservoir 256 of the receptacle body 220. The aperture 224 may be sealed with a plug 228 once the loose powder 230 has been loaded into the receptacle body 220. The plug 228 may be snap fit, screwed, bonded or otherwise secured to the receptacle body 220 in a manner that prevents powder 230 from escaping the body 220 through the aperture 224. It is also contemplated that embodiments which are constructed with the receptacle body 220 formed as a modular structure, the powder fill port (e.g., the aperture 224) formed through the bottom 226 of the body 220 may optionally be present.

The receptacle body 220 generally includes sidewalls 232 that extend upwards from the bottom 226 of the body 220. A distal end 234 of the sidewalls 232 defines an opening 236 of the receptacle body 220. The opening 236 is opposite the bottom 226 of the receptacle body 220. The opening 236 is sufficiently wide enough to receive the retainer plate 222.

In the example depicted in FIG. 2A, the distal end 234 of the sidewalls 232 forms a neck 238. The interior surface of the neck 238 bounds the opening 236, while the exterior surface of the neck 238 generally includes the male thread form 202. The interior surface of the neck 238 may also include a retention structure 240 that engages a complimentary retention structure 242 formed in the retainer plate 222 configured to prevent the retainer plate 222 from inadvertently becoming disengaged from the receptacle body 220. In one example, the retention structure 240 formed in the neck 238 is a dimple that engages the complimentary retention structure 242 formed as a recess in the retainer plate 222. In other examples, the retention structures 240, 242 may be complimentary grooves and ridges, thread forms, snap fits, quarter-turn structures, or other suitable retaining features. Alternatively, the retainer plate 222 may be press fit, staked, bonded, pinned, fastened or otherwise secured to the receptacle body 220 in another suitable manner.

In one example, the retainer plate 222 includes a web 246 of material and a mounting ring 244. The web 246 includes an application surface 250 that faces away from bottom 226 of the receptacle body 220. The mounting ring 244 and the web 246 may be fabricated as a singular or module structure. The retainer plate 222 may be fabricated from plastic, ceramic, glass, metal or other suitable material. The retainer plate 222 may optionally be fabricated from a material having a different, for example a contrasting, color relative to the loose powder 230 so that the mount of powder 240 present on the application surface 250 is more readily apparent to the user.

The web 246 of the retainer plate 222 includes a plurality of apertures 248. The apertures 248 are configured to allow the loose powder 230 to pass between the powder reservoir 256 and the upper plenum 260. In one example, the open area of the apertures 248 formed through application surface 250 is at least 10 percent. In another example, the open area of the apertures 248 formed through application surface 250 is at least 20, 30 or 40 or more percent. In still another example, the open area of the apertures 248 formed through application surface 250 is greater than 50 percent.

The apertures 248 may have any suitable size or shape. In one example, the apertures 248 are configured as circular holes. In other examples, the apertures 248 are elongated. In some examples, elongated apertures 248 may be straight or curved. In still other examples, the apertures 248 may have a swirl shape, a polygonal shape, a flower shape, and an animal shape or other suitable geometric forms. In still additional examples, the apertures 248 may for text or logo. Furthermore, the apertures 248 do not need to be uniform in size. For example, some apertures 248 may have twice, five or even 10 times the open area as other apertures 248.

The mounting ring 244 generally circumscribes the application surface 250 and is utilized to secure the retainer plate 222 to the receptacle body 220. As such the mounting ring 244 is generally sized to slip or press fit within the interior surface of the neck 238 of the receptacle body 220. As described above, the complimentary retention structure 242 is generally formed on the outside diameter of the mounting ring 244. The mounting ring 244 may also extend above the application surface 250. In examples where the receptacle body 220 and the retainer plate 222 are a singular component, the mounting ring 244 is omitted and the application surface 250 of the retainer plate 222 may extend inwards directly from the sidewall 232 of the receptacle body 220.

Figure 2B:
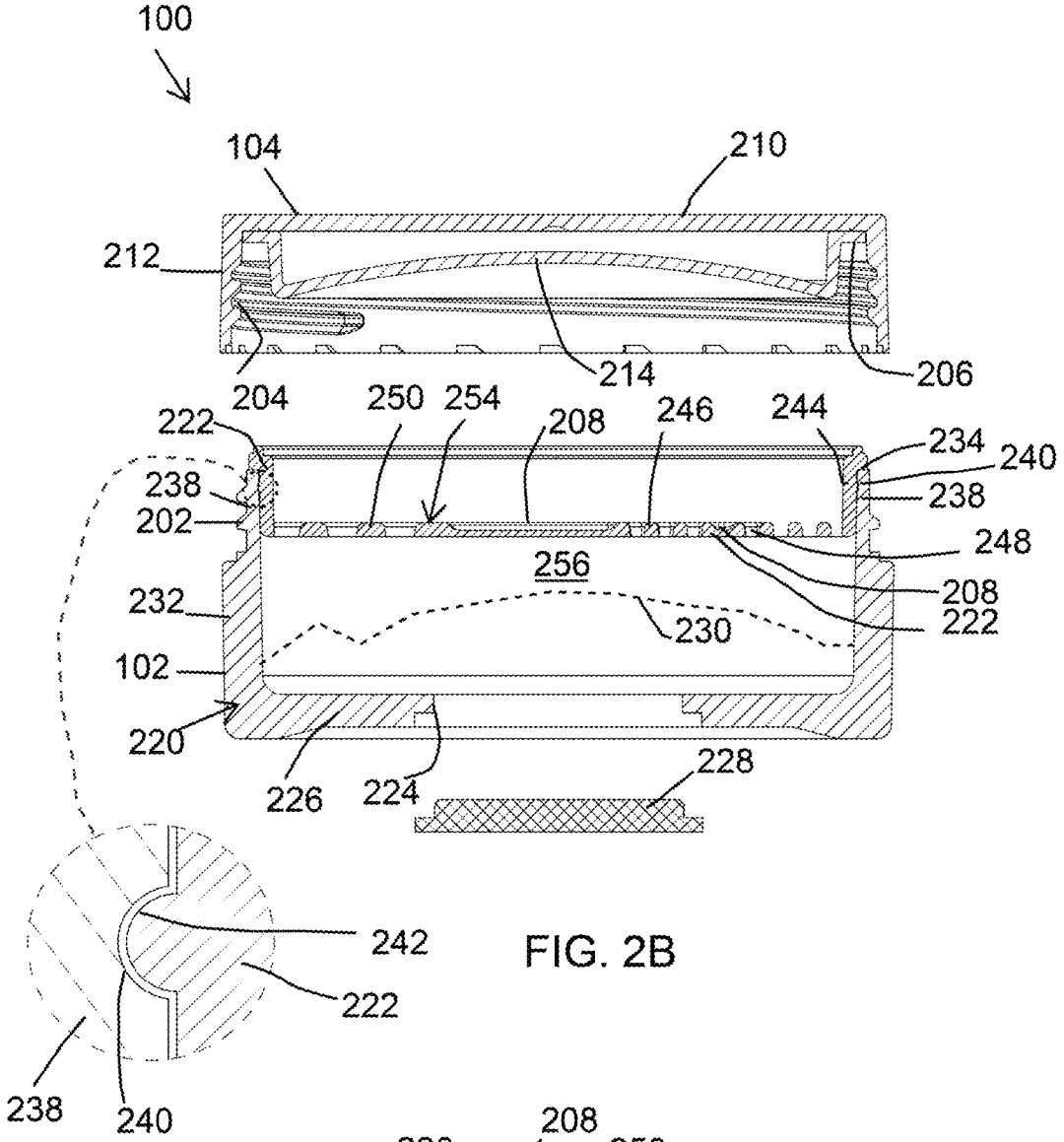
FIG. 2B is a side schematic for the powder container with the lid removed and shown spaced above the receptacle.

When the retainer plate 222 is secured to the receptacle body 220, the application surface 250 of the retainer plate 222 is recessed below the distal end 234 of the sidewalls 232. When the lid 104 is secured to the receptacle body 220, an upper plenum 260 is formed between the application surface 250 of the retainer plate 222 and the lid 104. When the lid 104 is removed to the receptacle body 220 to expose the upper plenum 260, an application tray 254 is defined between the application surface 250 of the retainer plate 222 and the portion of the interior surface of the neck 238 of the sidewall 232 and/or ring 244, (when present) extending above the application surface 250, as illustrated in FIG. 2B.

The lid 104 optionally includes a volume reducing feature 214. The volume reducing feature 214 also extends downward from the top 210 of the lid 104. In the example depicted in FIG. 2A, the volume reducing feature 214 does not extends as far from the top 210 of the lid 104 as the lip 212. The volume reducing feature 214 includes projecting surface configured to extend into the powder application tray 254 when the lid 102 closes the receptacle 104 without blocking the apertures 224 formed through the retainer plate 222. The volume reducing feature 214 serves to limit the volume of the upper plenum 260, and consequently, the amount of powder 230 that can be present above the retainer plate 222.

Continuing to refer to FIG. 2A, the retainer plate 222 also separates the powder reservoir 256 of the receptacle 102 from the upper plenum 260. The powder reservoir 256 is defined in the receptacle body 220 between the sidewalls 232 and bottom 226 of the body 220, and the bottom surface of the retainer plate 222. As discussed above, the container 100 is configured to allow the loose powder 230 to freely flow between the powder reservoir 256 of the receptacle 102 and the upper plenum 260 through application surface 250 of the retainer plate 222.

The web 246 includes one or more powder retaining features 208 that are configured to retain a predetermined amount of loose powder 230 on the application surface 250 facing the upper plenum 260. The size, number and location of the powder retaining features 208 may be selected such that a predetermined amount of powder is retained on the application surface 250 for transfer to the brush or puff applicator, advantageously controlling the dose of powder available to the applicator in a precise and repeatable manner that enables improved application of powder by the user and a generally more enjoyable user experience.

Figure 3:
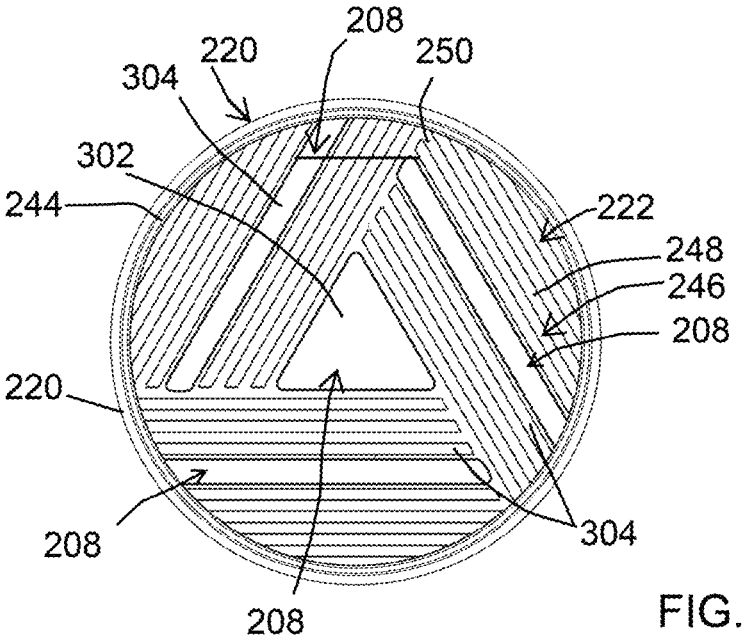
FIG. 3 a top view of the receptacle of the powder container illustrating one example of a retainer plate.

FIG. 3 a top view of the receptacle 104 of the powder container 100 illustrating one example of the retainer plate 222 having an exemplary configuration of apertures 248 and powder retaining features 208 distributed across the application surface 250. The powder retaining features 208 formed in the web 246 includes at least one or both of a central powder retaining feature 302 and at least a first secondary powder retaining feature 304. The central powder retaining feature 302 is located at the vertical centerline of the container 100, while the secondary powder retaining feature 304 is deposed radially offset from the vertical centerline of the container 100.

The central powder retaining feature 302 may have any suitable shape, and in the example depicted in FIG. 3, the central powder retaining feature 302 is triangular. One or more additional secondary powder retaining features 304 may optionally be disposed radially outward of the central powder retaining feature 302. The secondary powder retaining features 304 may be distributed symmetrically across the application surface 250. In one example, the secondary powder retaining features 304 are disposed parallel with one or more neighboring apertures 248 formed through the application surface 250. The secondary powder retaining features 304 may be coplanar with each other, and may also be optionally coplanar with the central powder retaining feature 302. In one example, the secondary powder retaining features 304 is farther from the bottom 226 of the receptacle body 220 than the central powder retaining feature 302. The secondary powder retaining features 304 may be arranged on chords of a circle defined by the outside diameter of the application surface 250 and/or retainer plate 222 and/or ring 244 of the retaining plate 222. In the example depicted in FIG. 3, three secondary powder retaining features 304 are shown along with a single central powder retaining feature 302. Each secondary powder retaining feature 304 is aligned in a direction than another secondary powder retaining feature 304. Also in the example depicted in FIG. 3, at least one or more apertures 248 are aligned in the same direction as each of the secondary powder retaining features 304. Additionally the apertures 248 illustrated in FIG. 3 are aligned in at least 3 different non-radial directions. Although the secondary powder retaining features 304 are illustrated as elongated linear troughs in FIG. 3, the secondary powder retaining features 304 may have alternative geometry.

Figure 4:
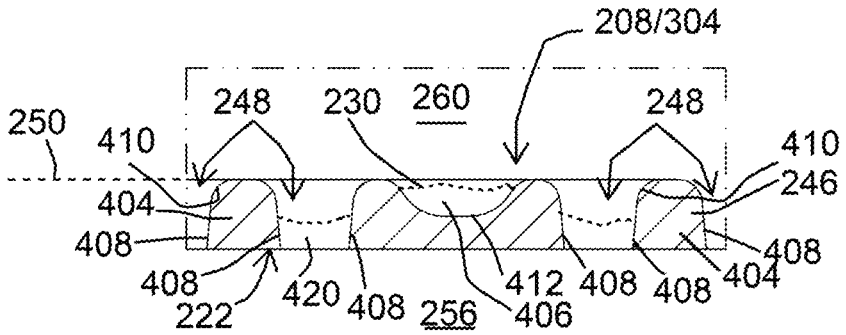
FIG. 4 is a partial side schematic for a retainer plate having one example of a powder retaining feature.

FIG. 4 is a side schematic for the retainer plate 222 of FIG. 3 illustrating one example of the secondary powder retaining feature 304. The single central powder retaining feature 302 may be fabricated similar to the secondary powder retaining feature 304. The secondary powder retaining feature 304 is disposed on a portion of the web 246 separated from adjacent portions of the web 246 by apertures 248. The portions of the web 246 bounded by apertures 248 may be configured as grates 404. Each grate 404 has a top surface that forms a portion of the application surface 250. The grates 404 include sidewalls 408 facing the apertures 248. The grates 404 may be elongated in a direction generally perpendicular to the vertical centerline of the container 100. The sidewalls 408 may also be interconnected by optional connecting tabs 420 that span across the apertures 248 to provide additional rigidity to the retainer plate 222. An edge 410 of the grate 404 adjacent the apertures 248 may be rounded or chamfered to encourage powder 230 present on top of the grate 404 to fall back into the powder reservoir 256 through the apertures 248. For example, the edge 410 may be configured as a full radius such that the top of the grate 404 that defines the application surface 250 is not flat. Thus, when the an upright container 100 is shaken or tapped, the powder 230 present on the application surface 250 falls off the grates 404 into the powder reservoir 256 through the apertures 248 except for the powder 230 retained on the powder retaining features 302, 304.

In the example depicted in FIG. 4, the secondary powder retaining feature 304 includes a recess 406 formed in a top surface 402 of the web 246. The recess 406 includes a bottom 412 that is below the plane of the application surface 250. The top surface 402 of the web 246 adjacent the recess 406 is coplanar with the application surface 250. Alternatively, the top surface 402 of the web 246 adjacent the recess 406 may be above or below the plane of the application surface 250. The volume of the recess 406 is generally selected to retain a predetermined amount of powder 230.

Figure 5:
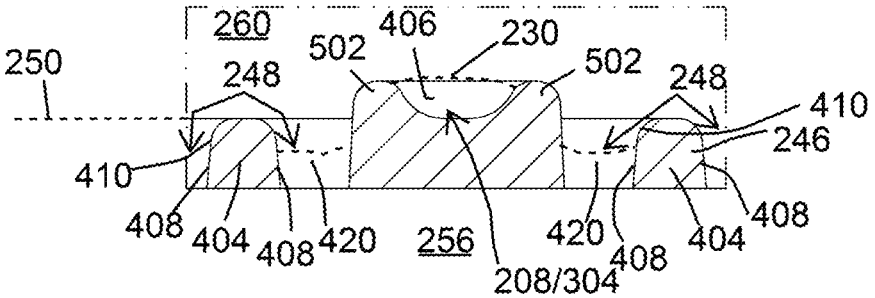
FIG. 5 is another partial side schematic for a retainer plate having another example of a powder retaining feature.

FIG. 5 is a partial side schematic for the retainer plate 222 of FIG. 3 illustrating an alternative example of the secondary powder retaining feature 304. The single central powder retaining feature 302 may optionally be fabricated similar to the secondary powder retaining feature 304 illustrated in FIG. 5. The secondary powder retaining feature 304 is separated from adjacent portions of the web 246 (e.g., the grates 404) by apertures 248.

In the example depicted in FIG. 5, the secondary powder retaining feature 304 includes a lip 502 extending above in a top surface 402 of the web 246. The lip 502 and top surface 402 form a recess 406 that is at least partially above the plane of the application surface 250 (as defined by the grates 404). Optionally, the top surface 402 of the web 246 (i.e., the bottom of the recess 406) may be above, coplanar or below the plane with the application surface 250. Alternatively, the top surface 402 of the web 246 adjacent the recess 406 may be above or below the plane of the application surface 250. The volume of the recess 406 is generally selected to retain a predetermined amount of powder 230, as discussed above.

Figure 6:
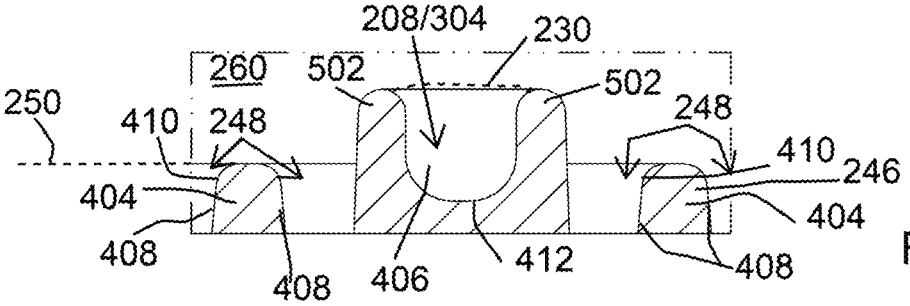
FIG. 6 is yet another partial side schematic for a retainer plate having yet another example of a powder retaining feature.

FIG. 6 is a partial side schematic for the retainer plate 222 of FIG. 3 illustrating yet another alternative example of the secondary powder retaining feature 304. The single central powder retaining feature 302 may optionally be fabricated similar to the secondary powder retaining feature 304 illustrated in FIG. 4 or 5. The secondary powder retaining feature 304 is separated from adjacent portions of the web 246 (e.g., the grates 404) by apertures 248.

In the example depicted in FIG. 6, the secondary powder retaining feature 304 includes both a lip 502 extending above the plane of the application surface 250, and also a recess 406 formed below the plane of the application surface 250 (as defined by the top surface the grates 404). The recess 406 includes a bottom 412 that is below the plane of the application surface 250. The volume of the recess 406 is generally selected to retain a predetermined amount of powder 230, as discussed above.

Figure 7:
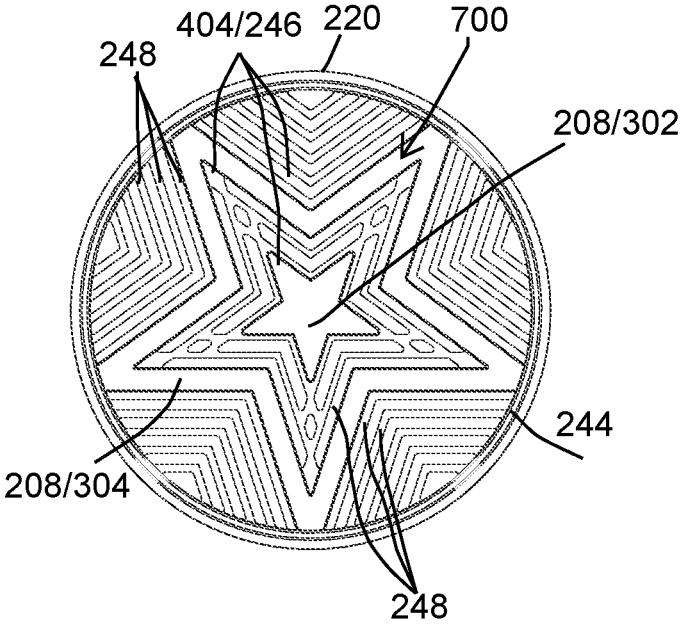
FIG. 7 is a top view of another example of a retainer plate that may be utilized with the powder container of FIG. 1.

FIG. 7 is a top view of another example of another example of a retainer plate 700 that may be utilized with the powder container 100 of FIG. 1. The retainer plate 700 is generally fabricated the identically as described above with reference to the retainer plate 222, except wherein the grates 404, apertures 248, the central powder retaining feature 302 and the secondary powder retaining features 304 have a star shape. These features may alternatively have a swirl shape, pentagon shape, a ring shape, a flower shape, and an animal shape or other suitable geometric forms. Suitable geometric forms include configurations where (a) the central powder retaining feature 302 has a first geometric shape and is separated from one or more the grates 404 by apertures 248; and (b) the secondary powder retaining features 304 has a second geometric form that is identical but larger than an outline of the first geometric form of the central powder retaining feature 302.

The application surface 250 of the retainer plate 700 may be planar, concave or convex. In the example depicted in FIG. 7, the application surface 250 is planar.

Figure 8:
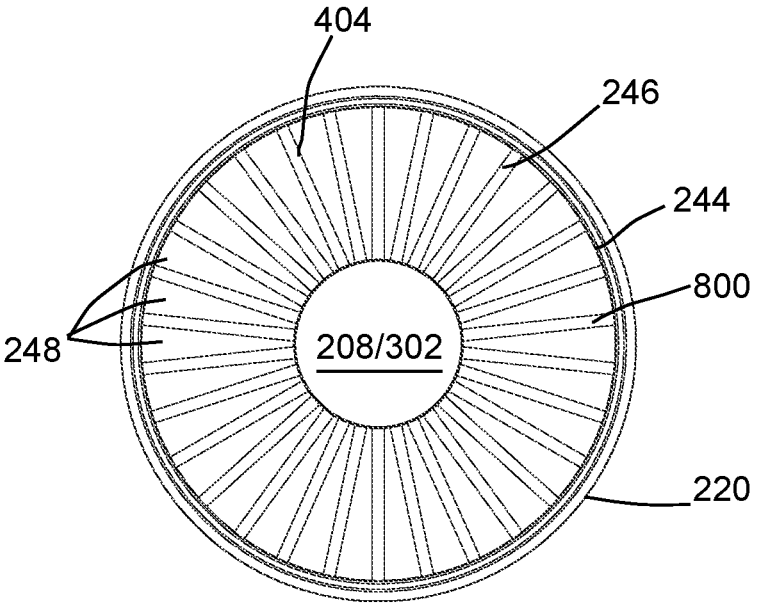
FIG. 8 is a top view of another example of a retainer plate that may be utilized with the powder container of FIG. 1.

FIG. 8 is a top view of another example of a retainer plate 800 that may be utilized with the powder container 100 of FIG. 1. The retainer plate 800 is generally fabricated the identically as described above with reference to the retainer plate 222, except wherein the grates 404 and apertures 248 have a radial orientation extending from the central powder retaining feature 302. Secondary powder retaining features are optional in the retainer plate 800 if FIG. 8.

Although central powder retaining feature 302 has a circular form in FIG. 8, the central powder retaining feature 302 may alternatively have other shapes, such as a star shape, a ring shape, a polygonal shape, a flower shape, and animal shape or other suitable geometric form. The central powder retaining feature 302 may be coplanar with, below or above the other portions of the application surface 250, such as the grates 404.

Figure 9:
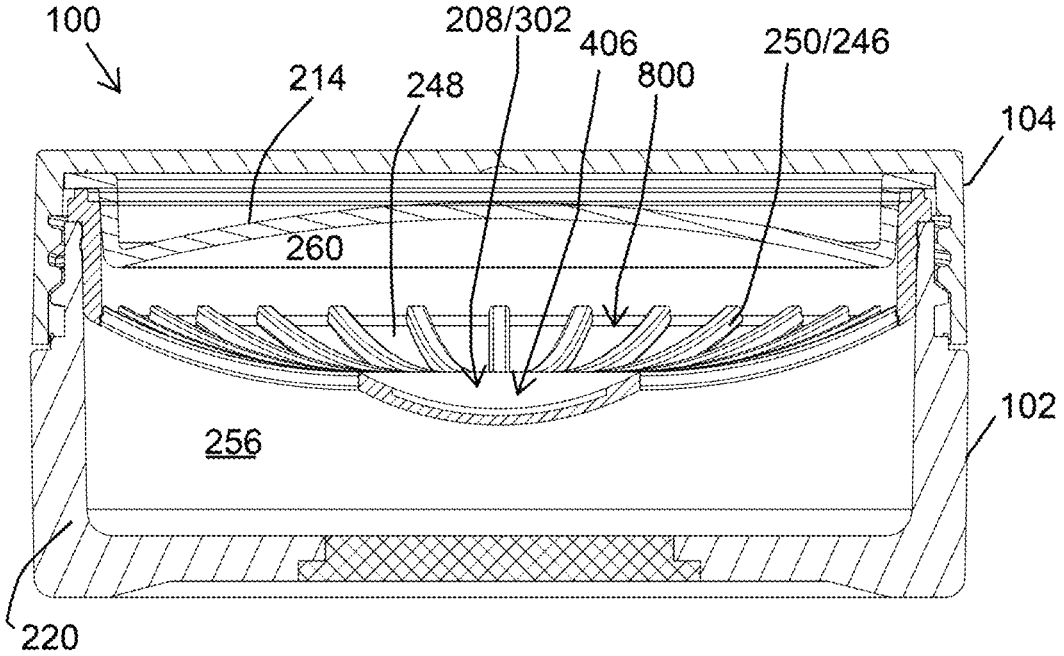
FIG. 9 is a side schematic for the retainer plate of FIG. 8.

FIG. 9 is a side schematic for one example of the retainer plate 800 of FIG. 8 that may be utilized with the powder container 100 of FIG. 1. In the example depicted in FIG. 9, the central powder retaining feature 302 of the retainer plate 800 is generally recessed below the at least a portion of the grates 404. In one example, the portion of the application surface 250 containing the central powder retaining feature 302 is planar, while the portion of the application surface 250 outward of the central powder retaining feature 302 is curved. For example as depicted in FIG. 9, the portion of the application surface 250 outward of the central powder retaining feature 302 is convex. The convex portion of the application surface 250 is configured to substantially match the profile of an applicator brush such that swirling the brush in contact with the application surface 250 both transfer powder 230 to the brush while the grates 404 simultaneously remove excess powder from the brush, allowing the excess powder to fall back through the apertures 224 and into the powder reservoir 256.

In operation, the container with the lid secured to the receptacle is shaken and/or turned upside down to allow loose powder to move from the powder reservoir to the upper plenum above the retainer plate. The container is then tapped in the upright (e.g., right-side-up) position to allow the excess powder within the upper plenum to fall back to the powder reservoir through the apertures in the retainer plate, leaving a predefined amount of powder disposed in the powder retainers. The lid is then removed, exposing the powder disposed in the powder retainers. The exposed powder in the application tray is then transferred to an applicator, such as a puff or brush. While transferring the powder disposed in the application tray to the applicator, the applicator can be swirled or otherwise moved across the grates, thus allowing excess powder present on the application to fall back to the powder reservoir through the apertures in the retainer plate, leaving a precise and repeatable amount of powder on the applicator for application by the user. Once the powder is applied, the lid is re-secured to the receptacle, closing the container without powder spillage or the need to manually return excess powder to the powder reservoir. As compared to conventional powder containers, the powder container disclosed herein is much less messy, uses less powder, and provide a more repeatable and precise application of powder, thus providing a more satisfying user experience.

While the foregoing is directed to embodiments of the present invention, other and further embodiments of the invention may be devised without departing from the basic scope thereof, and the scope thereof is determined by the claims that follow.

What is claimed is:

1. A cosmetic powder container comprising:

a lid; and a receptacle configured to be closed by the lid, the receptacle comprising:

a receptacle body having a bottom and a sidewall partially bounding a powder reservoir, the receptacle body having an opening separated from the bottom by the sidewall;

a retainer plate disposed between the powder reservoir and the lid, the retainer plate comprising:

a mounting ring; and a web of material having a top surface facing the lid and circumscribed by the mounting ring;

a plurality of apertures formed through the web of material, the plurality of apertures defining an open area of the top surface; and a powder retaining feature having a recess formed in a top surface of the web of material, the recess having a bottom in the web of material below the top surface; and an upper plenum defined between the lid and the retainer plate that is fluidly coupled to the powder reservoir through the plurality of apertures formed in the retainer plate when the receptacle is closed by the lid.

2. The cosmetic powder container of claim 1, wherein a volume of the upper plenum and the open area of the plurality of apertures formed through the top surface of the retainer plate are sufficient to allow free flow of powder between the upper plenum and the powder reservoir when the receptacle is closed by the lid.

3. The cosmetic powder container of claim 1, wherein the open area of the top surface of the retainer plate is at least 10 percent.

4. The cosmetic powder container of claim 1, wherein the open area of the top surface of the retainer plate is at least 20 percent.

5. The cosmetic powder container of claim 1, wherein the open area of the top surface of the retainer plate is at least 30 percent.

6. The cosmetic powder container of claim 1, wherein the open area of the top surface of the retainer plate is at least 50 percent.

7. The cosmetic powder container of claim 1, wherein the plurality of apertures in the web of material forms one or more grates.

8. The cosmetic powder container of claim 1, wherein edges of the top surface of the retainer plate surrounding at least two sides of one of the plurality of apertures is rounded.

9. The cosmetic powder container of claim 1, wherein a portion of the top surface of the retainer plate surrounding at least two sides of one of the plurality of apertures is not flat.

10. The cosmetic powder container of claim 1, wherein the top surface of the retainer plate is not flat.

11. The cosmetic powder container of claim 1, wherein the top surface of the retainer plate is concave.

12. The cosmetic powder container of claim 1, wherein at least one of the plurality of apertures is elongated.

13. The cosmetic powder container of claim 1, wherein the plurality of apertures are symmetrically distributed across the top surface of the retainer plate.

14. The cosmetic powder container of claim 1, wherein two of the plurality of apertures are separated by at least one of a secondary powder retention feature.

15. The cosmetic powder container of claim 14, wherein the secondary powder retention feature has a second recess formed in the top surface of the retainer plate.

16. The cosmetic powder container of claim 14, wherein a central powder retention feature is a depression formed in the top surface of the retainer plate.

17. The cosmetic powder container of claim 1, wherein the retainer plate is coupled to the receptacle body.

18. The cosmetic powder container of claim 1, wherein the retainer plate and the receptacle body are a single contiguous structure.

19. The cosmetic powder container of claim 1, wherein the receptacle body further comprises a powder fill port formed in the bottom of the receptacle body.

20. The cosmetic powder container of claim 1, further comprising: a powder application tray having a tray bottom and a tray sidewall, the tray sidewall formed by at least one of the receptacle body or the mounting ring of the retainer plate, the tray bottom formed by the top surface of the web of material of the retainer plate, and wherein the lid further comprises: a projecting surface configured to extend into the powder application tray when the lid closes the receptacle.

* * * * *